US009691542B2

(12) United States Patent
Kang

(10) Patent No.: US 9,691,542 B2
(45) Date of Patent: Jun. 27, 2017

(54) INDUCTOR AND DISPLAY APPARATUS INCLUDING THE SAME

(71) Applicant: Samsung Electronics Co., Ltd., Suwon-si (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 149 days.

(21) Appl. No.: 14/248,909

(22) Filed: Apr. 9, 2014

(65) Prior Publication Data

US 2014/0354526 A1 Dec. 4, 2014

(30) Foreign Application Priority Data

Jun. 3, 2013 (KR) ..... 10-2013-0063455

(51) Int. Cl.
*H01F 27/29* (2006.01)
*G09G 3/34* (2006.01)
(Continued)

(52) U.S. Cl.
CPC ..... *H01F 27/29* (2013.01); *G09G 3/3406* (2013.01); *G09G 3/36* (2013.01); *G09G 2300/04* (2013.01);
(Continued)

(58) Field of Classification Search
CPC ..... H01F 17/0013; H01F 17/0033; H01F 17/062; H01F 3/14; H01F 5/04;
(Continued)

(56) References Cited

U.S. PATENT DOCUMENTS 4,916,424 A * 4/1990 Kijima ..... H01F 27/325 336/160
5,457,872 A * 10/1995 Sakata ..... H01F 27/292 29/605
(Continued)

FOREIGN PATENT DOCUMENTS

CN 1229516 A 9/1999
EP 0422609 A 4/1991
EP 2317218 A 5/2011

OTHER PUBLICATIONS

The Internet Archive Wayback Machine, Cylinder Geometry, https://web.archive.org/web/20130130190334/http://en.wikipedia.org/wiki/Cylinder_(geometry).*
(Continued)

*Primary Examiner* — Priyank Shah
*Assistant Examiner* — Elliott Deaderick
(74) *Attorney, Agent, or Firm* — Sughrue Mion, PLLC

(57) ABSTRACT

An inductor configured to be mounted on a printed circuit board is provided. The inductor includes a drum core including a cylindrical body and first and second flanges extending from opposite ends of the cylindrical body, a coil wound around the cylindrical body, a plurality of pins on which opposite ends of the coil are wound, wherein each of the plurality of pins has one end fixed to the second flange and another end configured to be fixed to the printed circuit board, and at least one projection which protrudes from the second flange and is configured to support the inductor to stand vertically on the printed circuit board.

18 Claims, 9 Drawing Sheets

(51) Int. Cl.
*G09G 3/36* (2006.01)
*H01F 5/04* (2006.01)
*H01F 27/06* (2006.01)

(52) U.S. Cl.
CPC ..... *G09G 2310/0264* (2013.01); *G09G 2320/0626* (2013.01); *H01F 2005/046* (2013.01); *H01F 2027/065* (2013.01); *H01F 2027/297* (2013.01)

(58) Field of Classification Search
CPC ..... H01F 27/263; H01F 2005/046; H01F 2027/065; H01F 2027/297; H01F 27/29; G09G 2300/04; G09G 2310/0264; G09G 2320/0626; G09G 3/3406; G09G 3/36
See application file for complete search history.

(56) References Cited

U.S. PATENT DOCUMENTS 5,696,477 A * 12/1997 Yamamori ..... H01F 27/027 336/185
6,069,550 A * 5/2000 Huang ..... H01F 27/29 336/107
6,624,596 B1 * 9/2003 Ohsawa ..... H05B 41/042 315/276
7,372,351 B2 5/2008 Ikeda
7,477,122 B2 * 1/2009 Iguchi ..... H01F 17/045 336/192
2003/0137818 A1 7/2003 Chou
2006/0197459 A1 9/2006 Tsai
2008/0106505 A1 5/2008 Chou
2008/0106898 A1 5/2008 Park et al.
2009/0108979 A1 * 4/2009 Kosugi ..... H01F 38/10 336/208
2010/0091220 A1 * 4/2010 Lee ..... H05B 41/2855 349/70
2010/0182115 A1 7/2010 Huang et al.
2012/0262895 A1 10/2012 Quek et al.
2012/0313542 A1 12/2012 Yang et al.

OTHER PUBLICATIONS

Communication dated Jun. 6, 2014 issued by European Patent Office in counterpart European application No. 14152739.0.
Communication dated Jul. 27, 2016, issued by the European Patent Office in counterpart European Application No. 14152739.0.

* cited by examiner

INDUCTOR AND DISPLAY APPARATUS INCLUDING THE SAME

CROSS-REFERENCE TO RELATED APPLICATION

This application claims priority from Korean Patent Application No. 10-2013-0063455, filed on Jun. 3, 2013 in the Korean Intellectual Property Office, the disclosure of which is incorporated herein by reference in its entirety.

BACKGROUND

Field

Apparatuses and methods consistent with exemplary embodiments relate to an inductor and a display apparatus including the same, and more particularly, to an inductor and a display apparatus including the same, in which an inductor core is improved in shape to stand on a printed circuit board.

Description of the Related Art

A display apparatus may include a display panel for displaying an image. The display panel may display an image based on a broadcasting signal and/or video signals having various formats. If a liquid crystal panel that cannot emit light by itself is used as the display panel, a backlight unit may be needed to illuminate the display panel. Taking into account environmental contamination, response speed, energy conservation, etc., a light emitting diode (LED) may be employed as a light source of the backlight unit. Further, the display apparatus may include a driving circuit in order to drive the light source.

In the case where the LED is used as the light source, a high-efficiency switching type direct current to direct current (DC-DC) converter has been generally employed as the driving circuit. A backlight unit of a small display apparatus equal to or smaller than 32" may employ an inductor 1*a* to which a lead type drum core 2*a* is applied as shown in FIG. 1. The drum core 2*a* used in the inductor 1*a* may be fixed to a nonconductive base 4 by a bond or the like, and wound with a coil 3 to have desired electric characteristics. Both ends of the coil 3 may be wound around conductive pins 5 fixed to the base 4 and soldered, thereby completing the inductor 1*a*. The base 4 serves to form a sturdy electrode by fixing a body of the drum core 2*a*, and electrically insulating the drum core 2*a* from a wiring on a printed circuit board to which the inductor 1*a* is mounted.

Also, if the printed circuit board has a cross-section where the wiring is formed on only the rear of the printed circuit board, the inductor may be manufactured as shown in FIG. 3 by directly inserting and fixing a plurality of pins 5 in and to the drum core 2*b* instead of using the base, thereby reducing costs.

Referring to FIG. 4, a drum core type inductor 1*b* without using a base is applicable to only the printed circuit board that has the wiring on either of a first surface 6*a* to which the inductor 1*b* is mounted or a second surface 6*b* opposite to the first surface 6*a*.

The inductor 1*b* is manufactured by winding the coil around the drum core 2*b*, winding both ends of the coil 3 around the conductive pins 5, and soldering both ends of the coil 3 to the conductive pins 5. In the case of the inductor 1*b* manufactured as above, as shown in FIG. 4, when the inductor 1*b* is mounted to the printed circuit board 6, the inductor 1*b* is unbalanced and inclined by a finished portion 3*a* of the coil 3, thereby possibly causing contact failure, quality degradation, life-shortening, etc.

SUMMARY

One or more exemplary embodiments may be conceived with a drum core type inductor without using a base, and may provide an inductor and a display apparatus including the same, in which the inductor stands and remains horizontal on a printed circuit board so that mounting quality of an inductor may be improved.

According to an aspect of an exemplary embodiment, there is provided an inductor configured to be mounted on a printed circuit board, the inductor including a drum core including a cylindrical body and first and second flanges extending from opposite ends of the cylindrical body, a coil wound around the cylindrical body, a plurality of pins on which opposite ends of the coil are wound, wherein each of the plurality of pins has one end fixed to the second flange and another end configured to be fixed to the printed circuit board, and at least one projection which protrudes from the second flange and is configured to support the inductor to stand vertically on the printed circuit board.

A height of the projection may be greater than a height of a finished portions formed by winding the opposite ends of the coil around the pins.

The at least one projection may include at least three projections.

The projection may be integrated with the second flange.

The printed circuit board may include wiring on at least a first surface facing the inductor and a second surface opposite the first surface.

According to an aspect of another exemplary embodiment, there is provided a display apparatus including a video processor configured to process a video signal, a display that includes a backlight unit configured to emit light, wherein the display is configured to display an image with the emitted light based on the processed video signal, a driving circuit configured to drive the backlight unit, wherein the driving circuit includes a printed circuit board and an inductor mounted on the printed circuit board. The inductor includes a drum core including a cylindrical body and first and second flanges extending from opposite ends of the cylindrical body, a coil wound around the cylindrical body, a plurality of pins on which opposite ends of the coil are wound, wherein each of the plurality of pins has one end fixed to the second flange and another end fixed to the printed circuit board, and a projection which protrudes from the second flange and support the inductor to stand vertically on the printed circuit board.

The backlight unit may include at least one light emitting diode (LED) configured to emits the light.

A projection height may be greater than a height of a finished portion formed by winding both ends of the coil around the pin.

The at least one projection may include at least three projections.

The at least one projection may be integrated with the second flange.

The printed circuit board may include wiring on at least a first surface facing the inductor and a second surface opposite the first surface.

BRIEF DESCRIPTION OF THE DRAWINGS

The above and/or other aspects will be more apparent and more readily appreciated from the following description of exemplary embodiments, taken in conjunction with the accompanying drawings, in which.

DETAILED DESCRIPTION OF EXEMPLARY EMBODIMENTS

Figure 1:
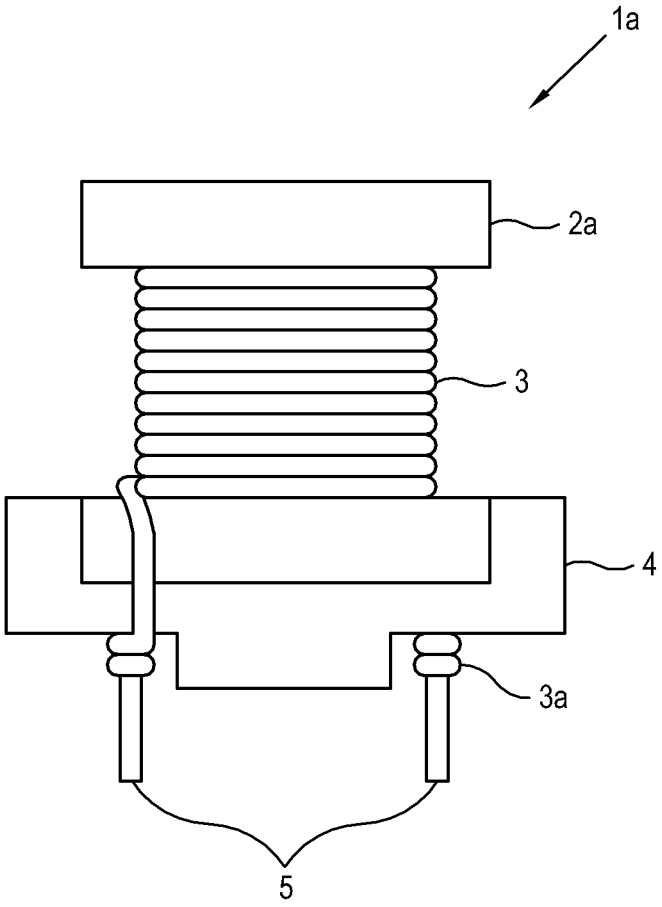
RELATED ART FIG. 1
FIG. 1 is a front view schematically showing a drum core type inductor with a base.
Figure 2:
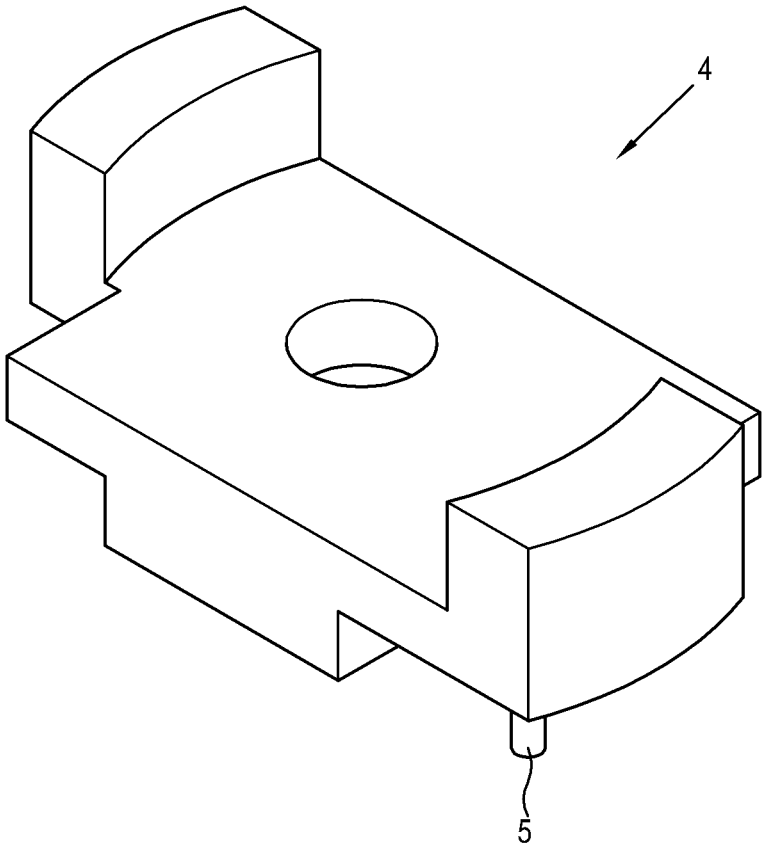
RELATED ART FIG. 2
FIG. 2 is a perspective view schematically showing a base of a drum core type inductor.
Figure 3:
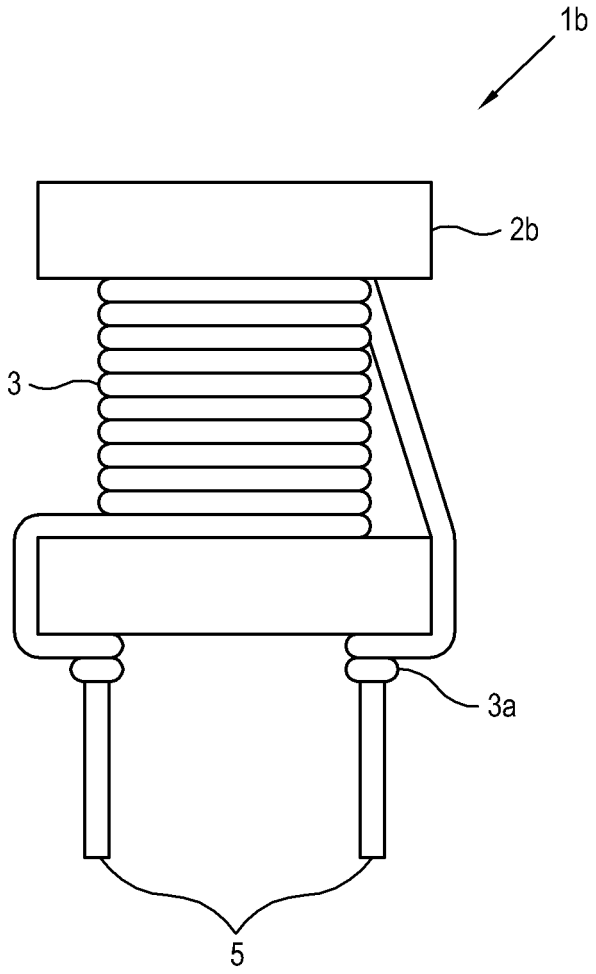
RELATED ART FIG. 3
FIG. 3 is a front view schematically showing a drum core type inductor without a base.
Figure 4:
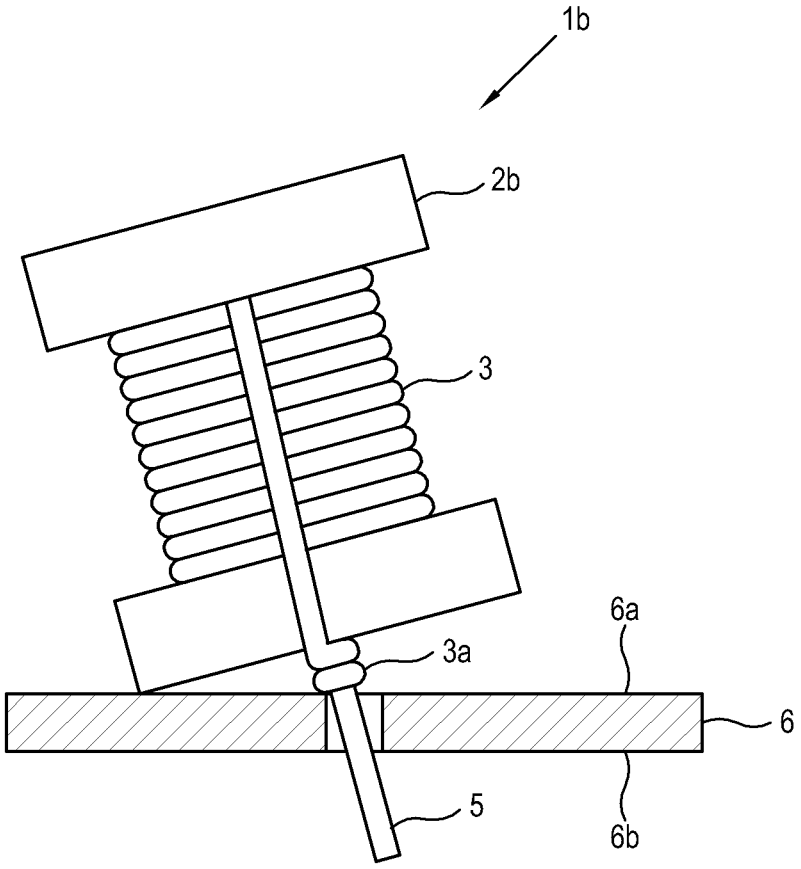
RELATED ART FIG. 4
FIG. 4 is a side view schematically showing that a drum core type inductor without a base being mounted on a printed circuit board.

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Throughout the drawings and the detailed description, unless otherwise described, the same drawing reference numerals will be understood to refer to the same elements, features, and structures. The relative size and depiction of these elements may be exaggerated for clarity, illustration, and convenience.

An inductor and a display apparatus including the inductor according to exemplary embodiments will be described in detail with reference to accompanying drawings.

Figure 7:
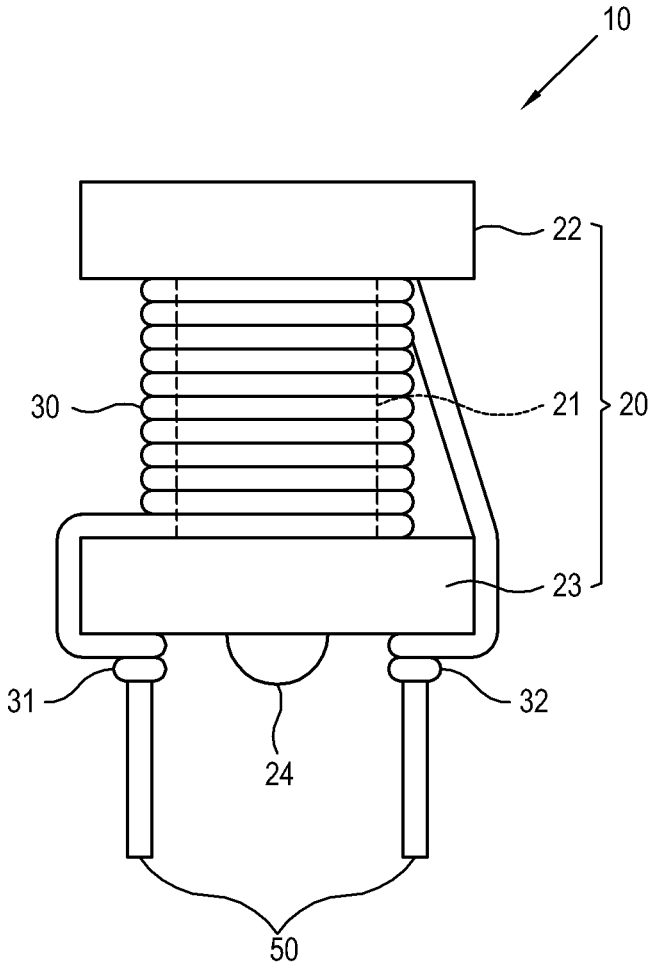
FIG. 7 is a front view schematically showing a drum core of an inductor according to an exemplary embodiment.

As shown in FIG. 7, an inductor 10 according to an exemplary embodiment includes a coil 30 through which electric current flows, a drum core 20 around which the coil 30 is wound, a plurality of pins 50 fixed to a lower surface of the drum core 20, and a projection 24 formed protruding from the lower surface of the drum core 20.

The coil 30 is provided as a wire having good conductivity to achieve inductance of the inductor 10. The wire is coated with an insulating material, and used as being wound cylindrically or spirally.

Figure 5:
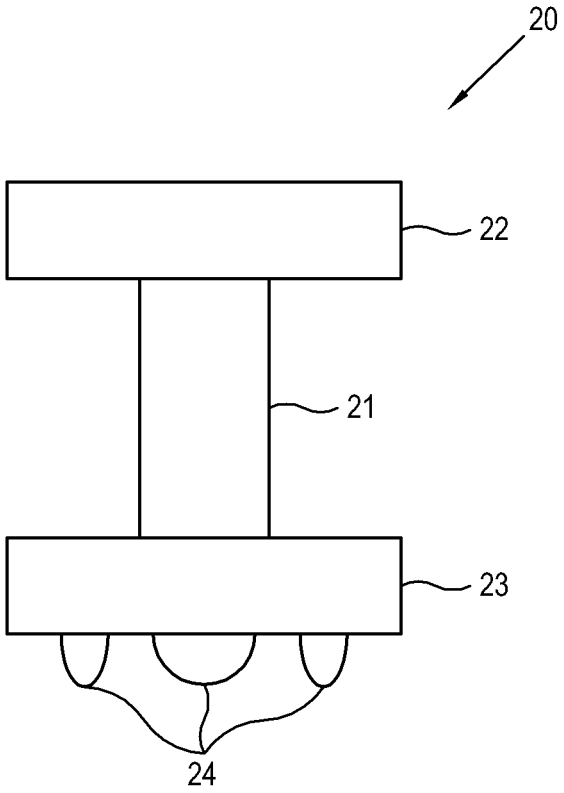
FIG. 5 is a front view schematically showing an inductor according to an exemplary embodiment.

Referring to FIG. 5, the drum core 20 includes a cylindrical body 21 around which a coil is wound, a first flange 22 extended from a top of the body 21, and a second flange 23 extended from a bottom of the body 21. The second flange 23 is formed with a plurality of projections 24.

The cylindrical body 21 is designed to have a diameter and a length corresponding to desired inductance, and is wound around with the coil.

Further, the drum core 20 may be made of ferrite.

As shown in FIG. 7, the plurality of pins 50 are provided in the form of cylindrical bars, each of which has one side inserted in and fixed to a hole 25 (refer to FIG. 6) formed in the second flange 23 and the other side inserted in and fixed to a hole 63 (refer to FIG. 8) formed in the printed circuit board. With this, the drum core 20 is fixed without being separated from the printed circuit board. In this exemplary embodiment, two pins 50 are provided, but the inventive concept is not limited thereto.

Further, the pins 50 are made of a conductor such as copper or the like. Both ends 31 and 32 of the coil 30 are fixed to the second flange 23, wound around the cylindrical body 21, and are wound around and fixed to the pins 50. At this time, both ends 31 and 32 of the coil 30 may be soldered and electrically connected to the pins 50.

Also, the pins 50 inserted in the printed circuit board may be soldered to the printed circuit board so as to be electrically connected and fixed to the wiring provided on the printed circuit board.

Figure 6:
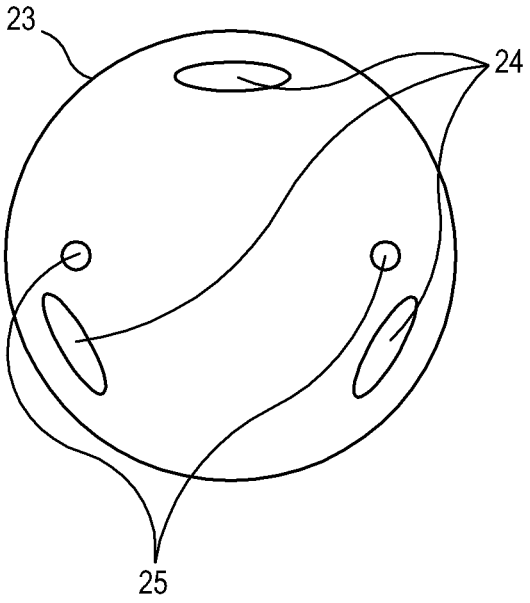
FIG. 6 is a bottom view schematically showing a drum core of an inductor according to an exemplary embodiment.

As shown in FIG. 5, the drum core 20 according to an exemplary embodiment includes the cylindrical body 21 standing with respect to FIG. 6, and the first and second flanges 22 and 23 extended from the top and bottom ends of the body 21. Here, the second flange 23 is a mounting surface facing the printed circuit board.

As shown in FIG. 6, the second flange 23 includes two holes 25 where the plurality of pins are inserted and fixed, and three projections 24 allowing the drum core 20 to stand while keeping horizontal on the printed circuit board.

The projections 24 are higher than a height of finished portions formed by winding both ends 31 and 32 of the coil 30 around the pins 50. With this structure as shown in FIG. 8, the drum core 20 can be placed and fixed such that the drum core 20 can maintain a horizontal position on the printed circuit board 60 regardless of the finished portions of the coil 32.

In this exemplary embodiment, three projections 24 are provided, but not limited thereto. Alternatively, more than three projections may be provided, and the projection may have any shape as long as it can keep the drum core horizontal in relation to the printed circuit board.

Also, the projection 24 may be integrated with the second flange 23 in consideration of productivity and production costs, but not limited thereto. Alternatively, the projection 24 may be separately manufactured and then coupled to the second flange 23.

Figure 8:
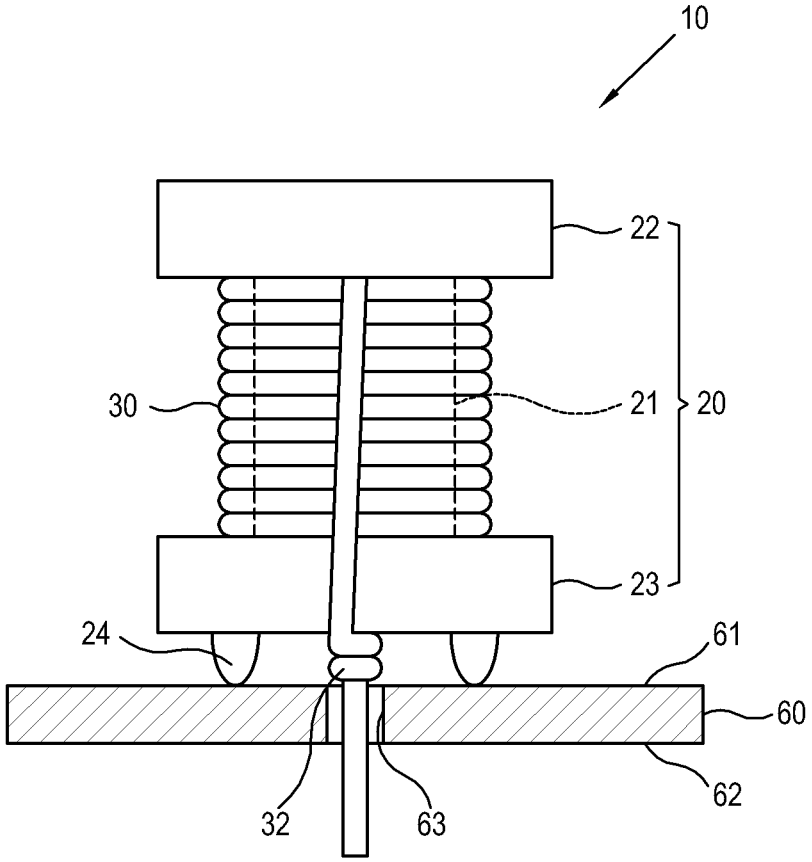
FIG. 8 is a side view schematically showing an inductor mounted on a printed circuit board according to an exemplary embodiment.

Referring to FIG. 8, the inductor 10 according to an exemplary embodiment includes the projections 24 on the second flange 23 of the drum core 20, and is thus spaced apart at a predetermined distance and electrically insulated from the printed circuit board 60 where the inductor 10 is mounted. Therefore, the inductor 10 according to an exemplary embodiment is applicable even if the wiring is provided on either or both of the top 61 and the bottom 62 of the printed circuit board 60.

The inductor 10 may be used in the display apparatus 100 according to an exemplary embodiment.

Figure 9:
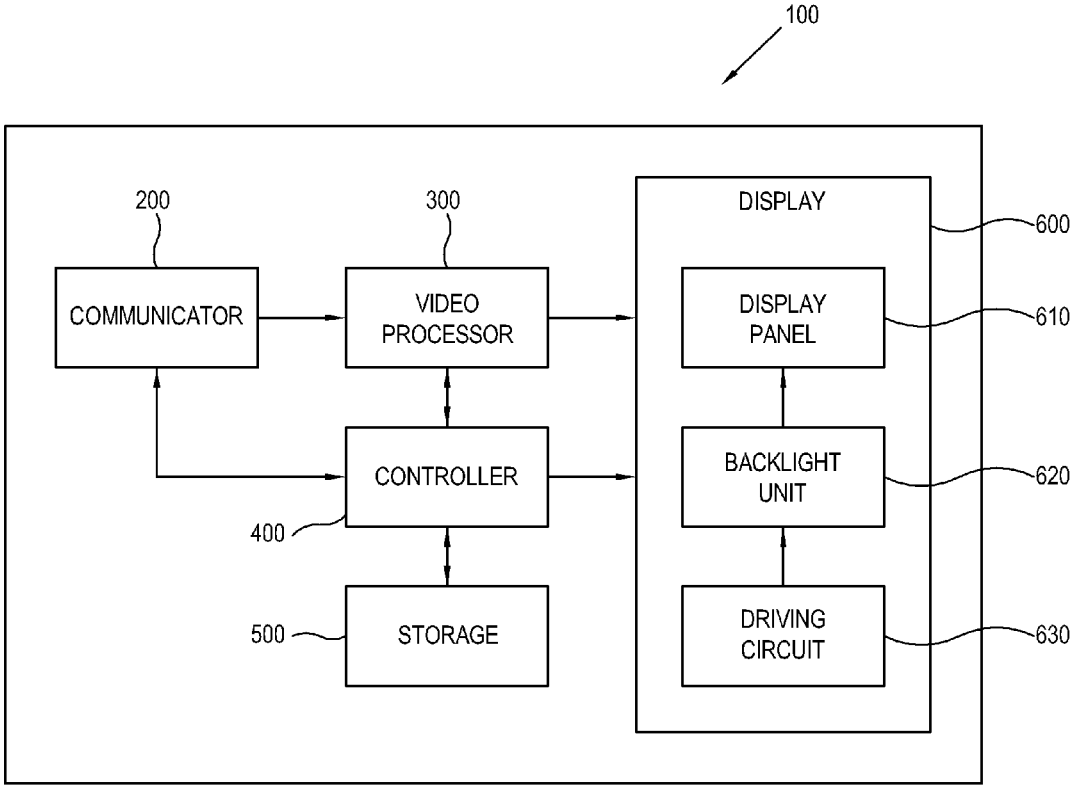
FIG. 9 is a block diagram schematically showing elements of a display apparatus.

FIG. 9 is a block diagram schematically showing the elements of a display apparatus.

As shown in FIG. 9, the display apparatus 100 may include a communicator 200 configured to receive a video signal or a user's command signal from the exterior, a video processor 300 configured to process the received video signal, a controller 400 configured to control operations of the display apparatus 100 in response to a command received through the communicator 200, a storage 500 configured to store information and programs needed for operating the display apparatus 100, and a display 600 configured to display an image based on the video signal processed by the video processor 300.

The display 600 includes a display panel 610 such as a liquid crystal panel or the like to receive light, a backlight unit 620 to emit light to the display panel 610, and a driving circuit 630 to drive the backlight unit 620.

The backlight unit 620 is provided behind, at top/bottom sides and/or at left/right sides of the display panel 610, and emits light to the display panel 610. As a light source for emitting light, at least one light emitting diode (LED) may be included in the backlight unit 620. Alternatively, various methods such as cold cathode fluorescent lamp, etc. may be used as long as it can emit light.

The driving circuit 630 includes a DC-DC converter that is a buck circuit or a boost circuit based on a high efficiency switching method.

The inductor 10 according to an exemplary embodiment may be used for storing energy of an input voltage in a filter of the driving circuit 630 that converts a level of the input voltage and outputs an output voltage.

For example, the buck circuit may include one inductor and two switches for controlling the inductor, and may connect the inductor with power, thereby alternating between an operation of storing energy in the inductor and an operation of discharging electricity regarding the inductor as load. Here, the inductor 10 according to an exemplary embodiment is used.

According to an exemplary embodiment, there are provided an inductor and a display apparatus including the inductor, in which the inductor is mounted keeping horizontal on the printed circuit board, thereby having an effect on improving a mounting quality of the inductor.

When the inductor is mounted on the printed circuit board, the inductor may be prevented from inclination, thereby having effects on minimizing soldering failure and preventing contact failure.

The inductor may not movable but stationary on the printed circuit board, thereby maybe having an effect on preventing damage due to bending in a contact portion or fatigue stress.

The number of parts may be reduced when the inductor is manufactured, thereby may be having effects on increasing productivity and reducing production costs.

Although a few exemplary embodiments have been shown and described, it will be appreciated by those skilled in the art that changes may be made in these exemplary embodiments without departing from the principles and spirit of the inventive concept, the scope of which is defined in the appended claims and their equivalents.

What is claimed is:

1. An inductor configured to be mounted on a printed circuit board, the inductor comprising:

a drum core comprising a cylindrical body and first and second flanges extending from opposite ends of the cylindrical body;

a coil wound around the cylindrical body;

a plurality of pins on which opposite ends of the coil are wound, wherein each of the plurality of pins has one end fixed to the second flange and another end configured to be fixed to the printed circuit board; and at least one projection which protrudes from the second flange in an axial direction of the cylindrical body and contacts a surface of the printed circuit board to support the inductor such that the axial direction of the cylindrical body is perpendicular to the surface of the printed circuit board, wherein the at least one projection is configured to directly project from the second flange without a base part interposed between the at least one projection and the second flange and to have a shape to keep the axial direction of the cylindrical body perpendicular to the surface of the printed circuit board without using the base part and the plurality of pins.

2. The inductor according to claim 1, wherein a height of the at least one projection is greater than a height of finished portions formed by winding the opposite ends of the coil around the plurality of pins.

3. The inductor according to claim 1, wherein the at least one projection comprises at least three projections.

4. The inductor according to claim 1, wherein the at least one projection is integrated with the second flange.

5. The inductor according to claim 1, wherein the printed circuit board comprises wiring on at least a first surface facing the inductor and a second surface opposite the first surface.

6. The inductor according to claim 1, wherein the at least one projection has a different dimension than each of the plurality of pins.

7. The inductor according to claim 1, wherein the second flange is a single piece that directly contacts the cylindrical body.

8. A display apparatus comprising:

a video processor configured to process a video signal;

a display that comprises a backlight unit configured to emit light, wherein the display is configured to display an image with the emitted light based on the processed video signal;

a driving circuit configured to drive the backlight unit, wherein the driving circuit comprises a printed circuit board and an inductor mounted on the printed circuit board, the inductor comprising:

a drum core comprising a cylindrical body and first and second flanges extending from opposite ends of the cylindrical body;

a coil wound around the cylindrical body;

a plurality of pins on which opposite ends of the coil are wound, wherein each of the plurality of pins has one end fixed to the second flange and another end fixed to the printed circuit board;

and at least one projection which protrudes from the second flange in an axial direction of the cylindrical body and contacts a surface of the printed circuit board to support the inductor such that the axial direction of the cylindrical body is perpendicular to the surface of the printed circuit board, wherein the at least one projection is configured to directly project from the second flange without a base part interposed between the at least one projection and the second flange and to have a shape to keep the axial direction of the cylindrical body perpendicular to the surface of the printed circuit board without using the base part and the plurality of pins.

9. The display apparatus according to claim 8, wherein the backlight unit comprises at least one light emitting diode (LED) configured to emit the light.

10. The display apparatus according to claim 8, wherein a height of the at least one projection is greater than a height of finished portions formed by winding opposite ends of the coil around the plurality of pins.

11. The display apparatus according to claim 8, wherein the at least one projection comprises at least three projections.

12. The display apparatus according to claim 8, wherein the at least one projection is integrated with the second flange.

13. The display apparatus according to claim 8, wherein the printed circuit board comprises wiring on at least a first surface facing the inductor and a second surface opposite the first surface.

14. An inductor comprising:

a drum core;

a coil wound around the drum core;

first and second pins, each of the first and second pins having one end fixed to a lower surface of the drum core, wherein one end of the coil is attached to the first pin and another end of the coil is attached to the second pin; and a plurality of projections which protrudes from the lower surface of the drum core in an axial direction of the drum core and contacts a surface of a printed circuit board to support the inductor such that the axial direction of the drum core is perpendicular to the surface of the printed circuit board, wherein the plurality of projections are configured to directly project from the lower surface of the drum core without a base part interposed between the plurality of projections and the lower surface of the drum core and to have a shape to keep the axial direction of the drum core perpendicular to the surface of the printed circuit board without using the base part and the first and second pins.

15. The inductor of claim 14, wherein the plurality of projections is further configured to support the inductor to stand vertically on the printed circuit board.

16. The inductor according to claim 14, wherein a height of at least one of the plurality of projections is greater than a height of finished portions formed by winding opposite ends of the coil around the first and second pins.

17. The inductor according to claim 14, wherein the plurality of projections comprises at least three projections.

18. The inductor according to claim 14, wherein the plurality of projections is integrated with a flange of the coil.

* * * * *